US006603249B2

(12) United States Patent
Garner

(10) Patent No.: US 6,603,249 B2
(45) Date of Patent: Aug. 5, 2003

(54) FLUORESCENT LAMP WITH REDUCED SPUTTERING

(75) Inventor: Richard C. Garner, Arlington, MA (US)

(73) Assignee: Osram Sylvania Inc., Danvers, MA (US)

( * ) Notice: Subject to any disclaimer, the term of this patent is extended or adjusted under 35 U.S.C. 154(b) by 4 days.

(21) Appl. No.: 09/961,473

(22) Filed: Sep. 24, 2001

(65) Prior Publication Data

US 2003/0057814 A1 Mar. 27, 2003

(51) Int. Cl.[7] ..... H01J 1/96; H01J 19/50; H01K 1/18

(52) U.S. Cl. ..... 313/274; 313/631; 313/240

(58) Field of Search ..... 313/274, 631, 313/240, 241, 242

(56) References Cited

U.S. PATENT DOCUMENTS 2,769,112 A 10/1956 Heine et al. ..... 313/272
4,454,447 A * 6/1984 Roche et al. ..... 313/492
4,870,323 A * 9/1989 Parks et al. ..... 313/546
5,449,971 A * 9/1995 Scott et al. ..... 313/631
5,880,558 A * 3/1999 Bauer ..... 313/631
6,274,981 B1 * 8/2001 Ronda et al. ..... 313/613
6,472,812 B2 * 10/2002 Vose et al. ..... 313/486

FOREIGN PATENT DOCUMENTS

JP 2000285861 A * 10/2000 ..... H01J/61/54

* cited by examiner

*Primary Examiner*—Vip Patel
*Assistant Examiner*—Kevin Quarterman
(74) *Attorney, Agent, or Firm*—Carlo S. Bessone

(57) ABSTRACT

A mount for a fluorescent lamp that comprises a glass base with spaced-apart lead-in wires extending from therefrom. A longitudinal electrode coil containing an emitter material is mounted upon and extends between the lead-in wires. A coating of zinc oxide is provided on the ends of the electrode coil and upon the lead-in wires at least in the area where the electrode coil is mounted.

4 Claims, 2 Drawing Sheets

FLUORESCENT LAMP WITH REDUCED SPUTTERING

TECHNICAL FIELD

This invention relates to fluorescent lamps and more particularly to fluorescent lamps having reduced sputtering effects. Still more particularly, it relates to mounts for such lamps.

BACKGROUND ART

Fluorescent lamps are energy efficient light sources. An arc discharge occurring in the lamp generates actinic radiation, which causes fluorescence from a contained phosphor coating on the interior of the lamp. The electron source is generally a metal coil, usually tungsten, containing an electron emissive material. Two such coils are provided, one at either end of an elongated glass tube. During operation of the lamp it is not unusual for sublimation or sputtered products from the coils to plate out on the inside surface of the lamp adjacent the coils, causing undesired darkening of the glass, reduced light output and limited life.

Prior techniques suggested for reducing the effects of sputtering have included application of shields or coating of portions of the emissive coil with glass or refractory material. For example, U.S. Pat. No. 2,769,112 suggests coating all of the interior metal parts, except the cathode, with a suspension of zirconium oxide or other refractory insulating oxide. These techniques are difficult to employ and are, therefore, uneconomical.

It would be an advance in the art to provide an efficient, economical means for reducing or eliminating such sputtering.

DISCLOSURE OF INVENTION

It is, therefore, an object of the invention to obviate the disadvantages of the prior art.

It is another object of the invention to reduce sputtering and the inherent loss of brightness caused thereby.

These objects are accomplished, in one aspect of the invention, by a mount for a fluorescent lamp that comprises a glass base with spaced-apart lead-in wires extending from therefrom. A longitudinal electrode coil containing an emitter material is mounted upon and extends between the lead-in wires. A coating of zinc oxide is provided on the ends of the electrode coil and upon the lead-in wires at least in the area where the electrode coil is mounted.

The use of this invention substantially reduces sputtering of the coil materials and thereby increases the useful life of the lamp. Further, it is simple and inexpensive to apply.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
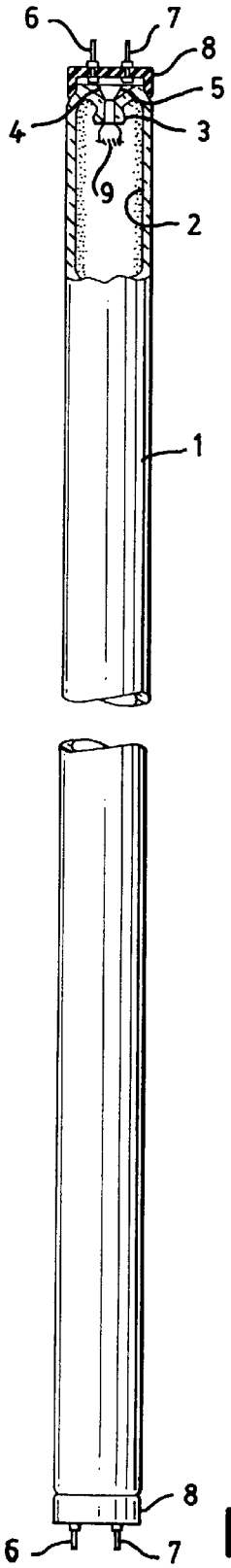
FIG. 1 is an elevational view of a fluorescent lamp, partially in section.
Figure 2:
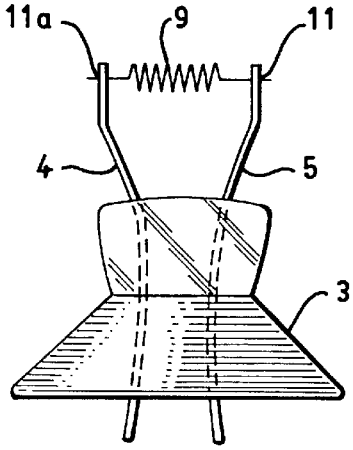
FIG. 2 is an elevational view of a prior art mount structure.

Referring now to the drawings with greater particularity, there is shown in FIG. 1 a fluorescent lamp having an envelope 1 with a phosphor coating 2 on the inside surface thereof. Electrode mounts 3 (only one of which is shown) seal each end of the envelope. Spaced apart lead-in wires 4 and 5 are sealed into the mount 3 and project in a first direction into the envelope 1 and in a second direction out of the envelope 1 where they are connected to connector pins 6 and 7 that are fitted into an end cap 8. An electrode coil 9 constructed of coiled-coil tungsten wire and embedded with an emissive material, such as the usual triple carbonates of barium, calcium and strontium, is mounted between the lead-in wires 4 and 5 and connected thereto, as by welding or crimping, at 11 and 11*a*.

During the start-up of such fluorescent lamps the cathode fall voltage is typically high (>100V) because the discharge must be sustained by ion-induced secondary electron emission from the cathode (a so-called glow discharge). High ion energies are necessary to obtain the amount of electron emission required by the discharge. Feedback is established between cathode and discharge whereby the discharge produces the cathode fall necessary to impart the ion energy needed to produce the secondary emission required by the discharge.

Eventually the high energy ion bombardment heats the electrode to sufficiently high temperatures so that the discharge can be sustained by thermionic emission of electrons. At this point the cathode fall drops precipitously (to 10 15 volts) and secondary emission is negligible (a so-called thermionic arc). The discharge subsequently operates in this mode until it is switched off. The starting phase may last on the order of tens of milliseconds if no auxiliary heating of the electrode is applied (for example, by passing current through the coil).

The unwanted sputtering occurs during this start-up phase. The high energy ions needed to sustain the discharge cause ejection of material from the electrode and this ejected material migrates to the wall of the envelope adjacent the electrode causing end-darkening and lumen reduction on the order of 1 to 2%. In a typical fluorescent lamp this ejected material includes the components of the emitter coating (barium strontium and calcium) as well as the material comprising the coil (tungsten) and the lead-in wires (nickel, iron). Much of this sputtered material can also deposit back on to the emitter itself, leading to an ineffective or poorly performing electrode.

The emitter coating on the coil is responsible for the low work function that allows for thermionic emission at reasonable temperatures (i.e., temperatures at which evaporative losses of emitter are fairly low). Without emitter material the electrode either heats up to extremely high temperatures (leading to high evaporative losses) or it cools and the discharge reverts to a glow (with very high cathode fall). In either case the electrode does not last very long. Eventually, the electrode will break and the lamp will fail.

Alkaline earth atoms ejected from the electrode are known to react with mercury. Studies of material deposited on the inner wall of fluorescent lamps in the end regions (after long operation) reveal spatial correlation of barium, strontium and mercury atoms. Furthermore, the mercury atoms involved in these interactions are not available to the discharge. That is, the mercury is consumed. This so-called mercury end-loss represents a significant portion of the overall mercury consumption in a fluorescent lamp. The greater amount of emitter material lost from the electrode, the greater the dose of mercury required by the lamp.

Therefore, if the sputtering of electrode material during starting can be reduced or eliminated then the lamp lifetime would lengthen, mercury consumption rate would decrease, and lumen output would not degrade as quickly.

It has been discovered that applying a coating of zinc oxide (ZnO) to the end regions of the electrode causes a drastic reduction of sputtering during starting.

The use of zinc oxide as an end coat has many advantages compared to the prior art techniques. The zinc oxide is particularly easy to apply and it mixes well with a number of binders, including the standard binder used to deposit the barium, calcium, strontium carbonate mix. Alcohol is also a suitable binder. The zinc oxide with binder readily seeps into the secondary winding of a coiled-coil. Thus, application is a simple additive step in the lamp manufacturing process. The zinc oxide does not require any chemical conversion. During electrode processing the temperature merely has to get high enough so that the binder evaporates (100 to 200° C.). The zinc oxide is non-toxic, readily available commercially, and is stable. Further, tests have shown it to have minimal effect on lamp operation.

Figure 3:
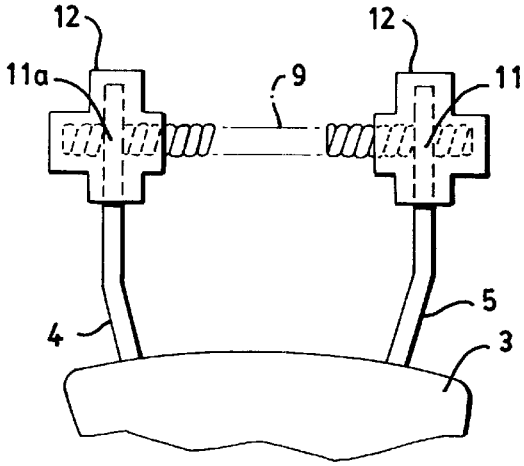
FIG. 3 is an enlarged elevational view of a mount of the invention.

FIG. 3 illustrates the area to which the zinc oxide 12 is applied, the zinc oxide covering the ends of the electrode coil 9, the connection points 11 and 11*a,* and the upper portion of the lead-in wires 4 and 5.

Application for test purposes was achieved by mixing the zinc oxide with the standard binder mix used to apply the carbonates, on a 50/50 basis, by weight. The zinc oxide employed was Alpha Aesar, 99.99% on a metals basis. After mixing the result was a white liquid with approximately the consistency of whole milk. A stainless steel spatula was used to apply the liquid to the bare ends of the electrodes. A drop of liquid was made to adhere to the spatula by surface tension and was then brought into contact with the bare coil. The liquid readily seeped into the secondary winding of the coil.

The electrodes were sealed into a standard T8 lamp tube. Prior to sealing, the phosphor was wiped from the end regions of the lamp tube to allow better visibility of the experiment. The tube was processed in the usual fashion using argon as the buffer gas at 2.5 Torr. A control lamp was made using the same procedure, the only difference being that the control lamp had no zinc oxide on the electrodes.

The lamp with the zinc oxide end-coat and the control lamp were placed on a lifetest rack and cycled on and off with a 10 sec on/10 sec off schedule. The first visual inspections were performed after approximately 3000 starts. At this point the control lamp showed severe darkening on both sides while the zinc oxide coated lamp showed virtually no end darkening. The first, slight end darkening of the zinc oxide coated lamp occurred at about 4200 starts.

At approximately 3500 cycles the lamps were removed from the life test rack to measure barium loss during starting. This was done non-intrusively with an atomic absorption based diagnostic. The diagnostic measures the transmission of 455 nm light (i.e., transition of Ba+) through the lamp in the electrode region. A decrease in transmission during the discharge (relative to the transmission in the absence of discharge) is due to absorption by barium ions. Barium ions are present due to sputtering of neutral barium from the electrode and subsequent ionization by the electrons in the discharge. The diagnostic is sensitive only to the large amounts of barium ejected during starting and not the small amounts evaporated during steady state.

The barium absorption diagnostic was applied to one electrode of each lamp while they operated on a 10 sec on/10 sec off cycle. Data were acquired for 100 starts and these data are presented in FIG. 4. Data for each start consisted of 455 nm light transmission during the first second after lamp turn-on. Most of the absorption of this light occurs during the glow discharge phase, although there is some absorption for a short time after the discharge becomes thermionic. Total barium mass loss during the first second is inferred from these data. The results are accurate only in a relative sense.

The averages and standard deviations of the barium mass loss per start for the 100 starts of both lamps are: Control lamp, 39.0±15.5 and ZnO lamp, 12.4±12.5. The numbers represent arbitrary units.

The average mass loss for the control lamp is approximately three time that of the ZnO lamp.

Figure 4:
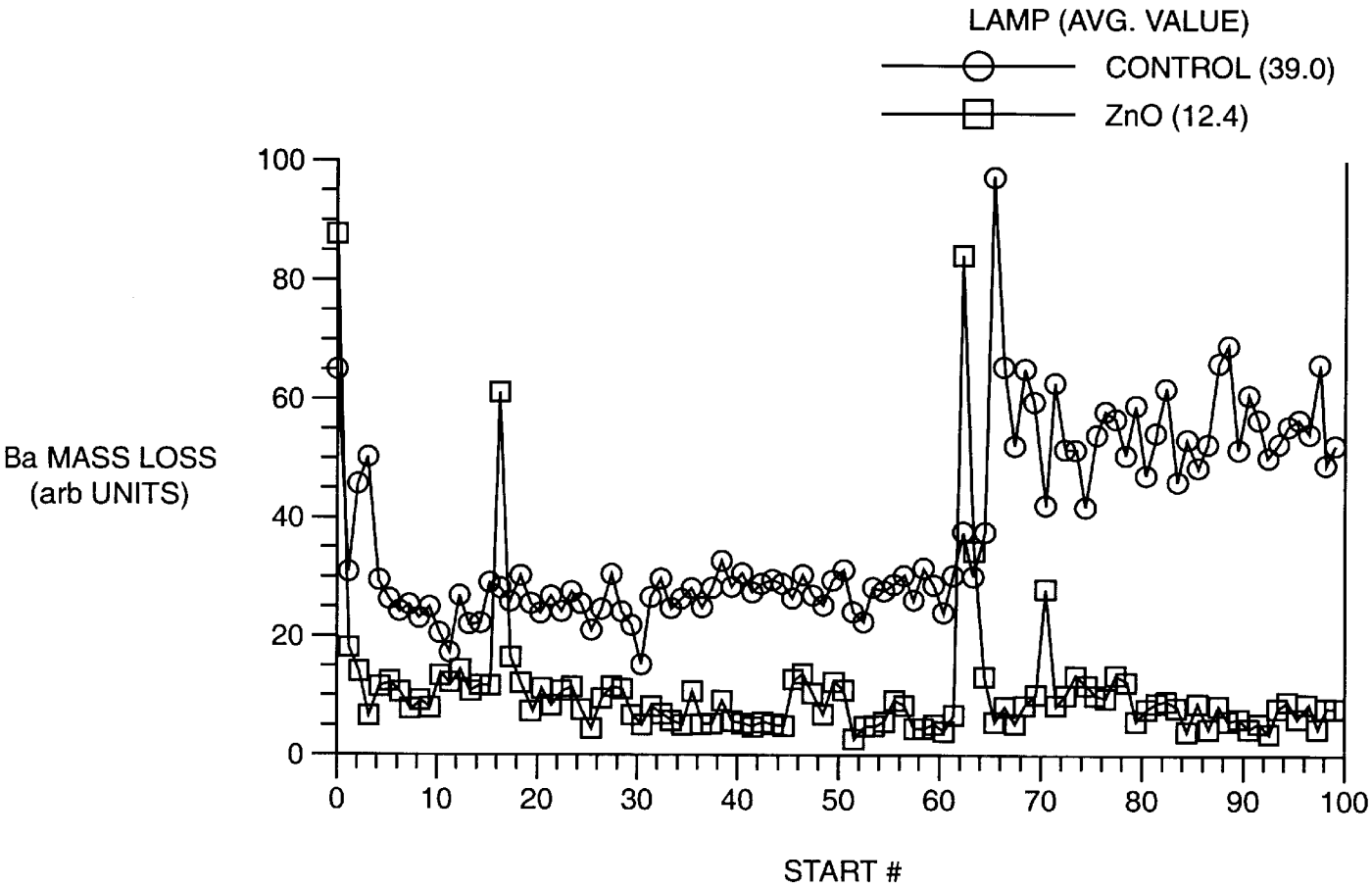
FIG. 4 is a graph of barium mass loss in a control lamp and a lamp of the invention.

The standard deviations are relatively high because of the occasional large fluctuations in mass loss, as seen in FIG. 4. Also, the control lamp shows a sudden, unexplained shift to higher mass loss at the $65^{th}$ start. Nonetheless, the data indicate a clear difference between the control and the ZnO lamps. The result, of course, is consistent with the visual observations and with the discharge voltages measurements discussed above.

Thus, it is shown that application of a ZnO coating to the otherwise bare end regions of triple carbonate electrodes drastically reduces the amount of sputtering during starting of fluorescent lamps. The ZnO is particularly easy to apply to coils. It mixes readily with many binders. It does not require chemical conversion; it is non-toxic and readily available.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A mount for a fluorescent lamp comprising:

a glass base;

spaced-apart lead-in wires extending from said base;

a longitudinal electrode coil containing an emitter material mounted upon and extending between said lead-in wires; and a coating of zinc oxide on the ends of said electrode coil and upon said lead-in wires at least in the area where said electrode coil is mounted.

2. A fluorescent lamp comprising:

a glass envelope having two ends;

a mount sealing each of said ends, said mounts comprising a glass base;

spaced-apart lead-in wires extending from said base;

a longitudinal electrode coil containing an emitter material mounted upon and extending between said lead-in wires; and a coating of zinc oxide on the ends of said electrode coil and upon said lead-in wires at least in the area where said electrode coil is mounted.

3. The mount of claim 1 wherein said electrode coil is formed of tungsten and said emitter material includes barium carbonate.

4. The mount of claim 1 wherein said lead-in wires include at least nickel and iron.

* * * * *